US005575742A

United States Patent [19]

Wu

[11] Patent Number: 5,575,742

[45] Date of Patent: Nov. 19, 1996

[54] MULTIPURPOSE EXERCISE APPARATUS

[76] Inventor: Tien-Lai Wu, 58, Ma Yuan West St., Taichung, Taiwan

[21] Appl. No.: 417,293

[22] Filed: Mar. 6, 1995

[51] Int. Cl.[6] ..... A63B 21/00

[52] U.S. Cl. ..... 482/92; 482/142; 482/52

[58] Field of Search ..... 482/52, 51, 53, 482/114, 127, 133, 121, 92, 148, 140, 142; 312/257.1, 293.1, 321, 352, 902

[56] References Cited

U.S. PATENT DOCUMENTS

| | | | |
|---|---|---|---|
| 3,664,666 | 5/1972 | Lloyd | 482/133 |
| 3,893,667 | 7/1975 | Snyder et al. | 482/114 |
| 4,131,196 | 12/1978 | Csutor | 482/51 |
| 4,478,413 | 10/1984 | Siwula | 482/127 |
| 5,230,676 | 7/1993 | Terauds | 482/53 |
| 5,316,528 | 5/1994 | Ziparo | 482/52 |

*Primary Examiner*—Stephen R. Crow

[57] ABSTRACT

An exercise device includes a housing having a hollow interior for receiving objects and having a rear wall and a front wall. Two tubes are secured in the walls. Two rods are engaged with the bottom portions of the tubes so as to form a stable base for the housing. Two bars are secured to the tubes and soft sleeves are engaged on the bars for engaging with the feet of the users. The exercise device may be used for conducting acrobatic dance, sit-up exercises and other exercises.

1 Claim, 7 Drawing Sheets

MULTIPURPOSE EXERCISE APPARATUS

BACKGROUND OF THE INVENTION

1. Field of the Invention

The present invention relates to an exercise apparatus, and more particularly to a multipurpose exercise apparatus.

2. Description of the Prior Art

Typical exercise apparatus and typical exercise mechanisms comprise a huge configuration that may not be folded to a rather compact configuration such that the typical exercise mechanisms are not good for storing and transportation purposes.

The present invention has arisen to mitigate and/or obviate the afore-described disadvantages of the conventional exercise apparatus.

SUMMARY OF THE INVENTION

The primary objective of the present invention is to provide a multipurpose exercise apparatus which may be folded to a compact configuration for storing and for transportation purposes.

In accordance with one aspect of the invention, there is provided an exercise apparatus comprising a housing including a hollow interior for accommodating objects, including a rear wall and a front wall, and including an upper portion having a cover pivotally coupled to the housing, the rear wall and the front wall each including a hole vertically formed therein, means for pivotally coupling the cover and securing the cover to the housing, two tubes secured in the holes respectively, the tubes each including a bottom portion and an upper portion, and two rods each including a stud extended therefrom for engaging with the bottom portion of the tube so as to form a stable base for the housing.

The housing includes a rear portion having wheel means provided thereon for moving the housing and includes a handle secured to the front wall for carrying the housing.

Two bars are secured to the upper portion and the lower portion of at least one of the tubes, and soft sleeve means are engaged on the bars for engaging with the feet of the users.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 9:
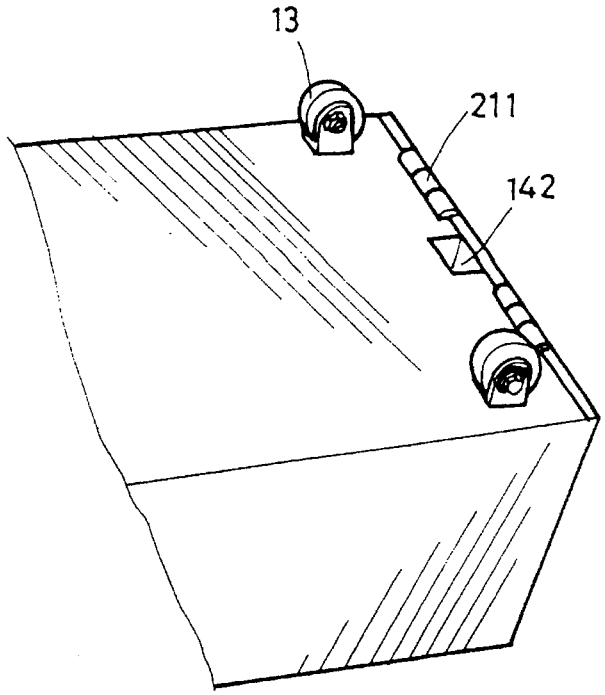
Figure 8:
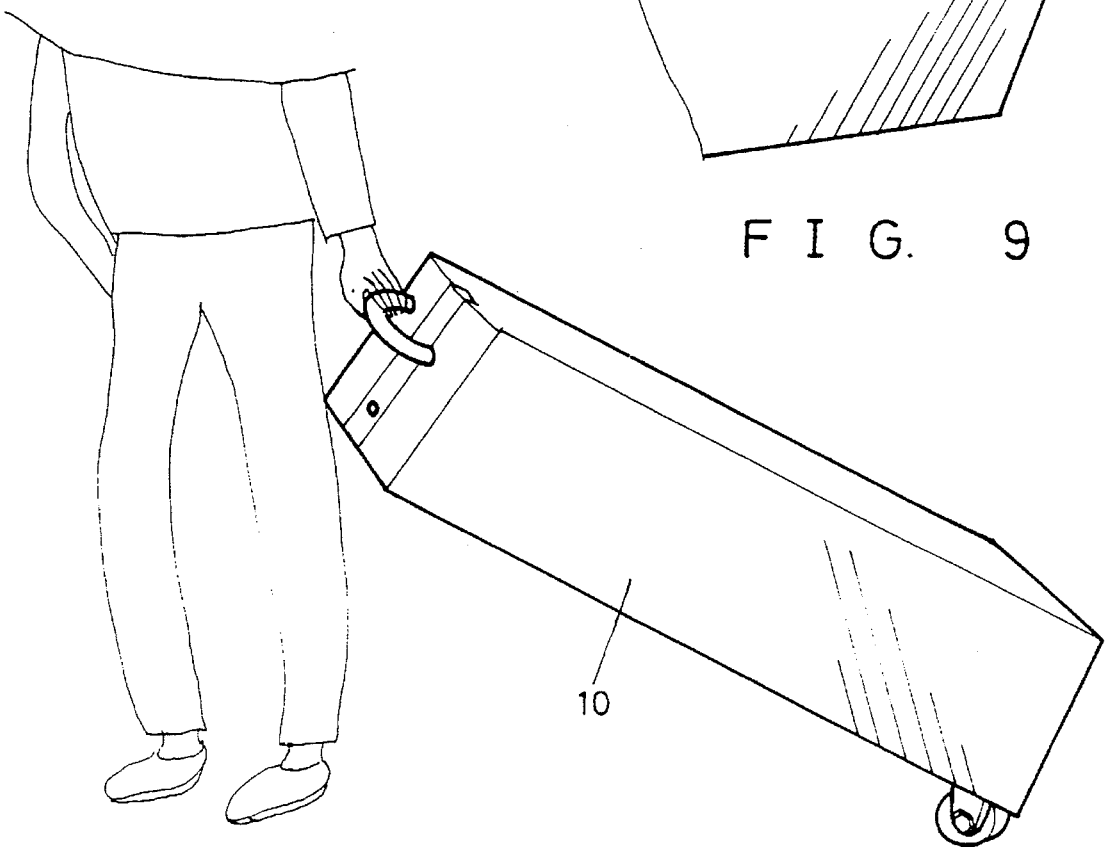

Referring to the drawings, and initially to FIGS. 1 to 4, an exercise apparatus in accordance with the present invention comprises a housing 10 including a hollow interior for accommodating exercise devices such as exercise bicycles, dumb bells, towels and other objects for exercise purposes. The housing 10 includes a rear wall 14 having a wheel means 13 provided thereon for moving the housing 10 and includes a front wall 140 having a handle secured thereto for carrying the housing 10, best shown in FIG. 8. The rear wall 14 is pivotally coupled to the housing by a hinge member 211 (FIG. 9) such that the rear wall 14 may rotate about the hinge member 211. The walls 14, 140 each includes a hole 142 vertically formed in the center portion thereof for securing a tube 40 therein. The tube 40 includes a screw hole 402 formed in the bottom portion.

Figure 1:
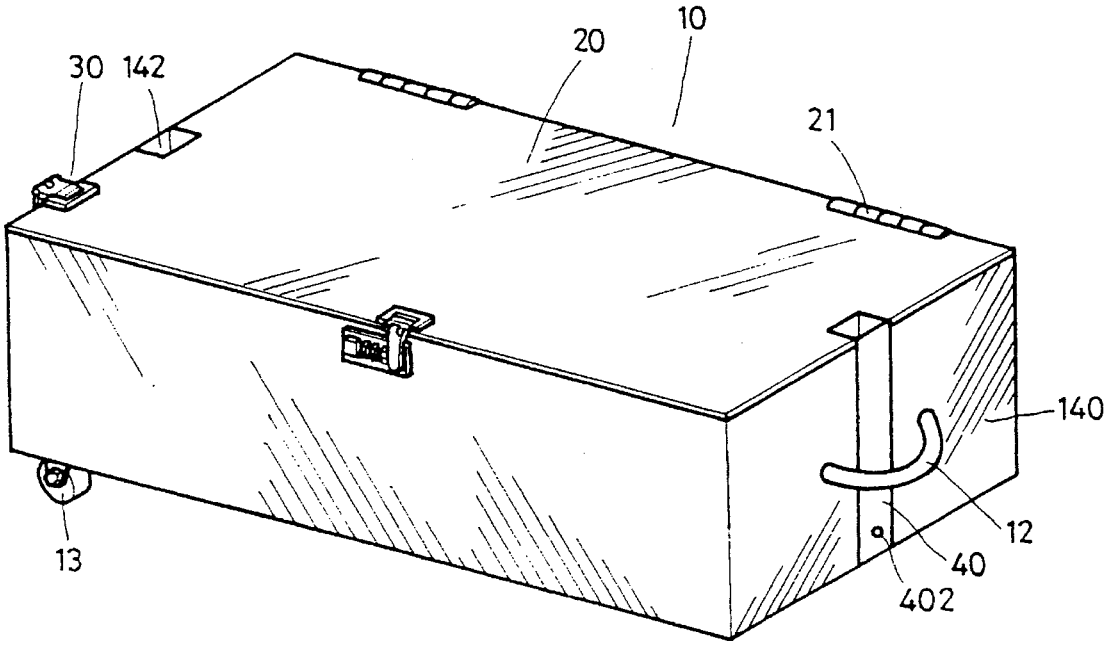
FIGS. 1 and 2 are perspective views showing the closed and open status of an exercise apparatus in accordance with the present invention.
Figure 2:
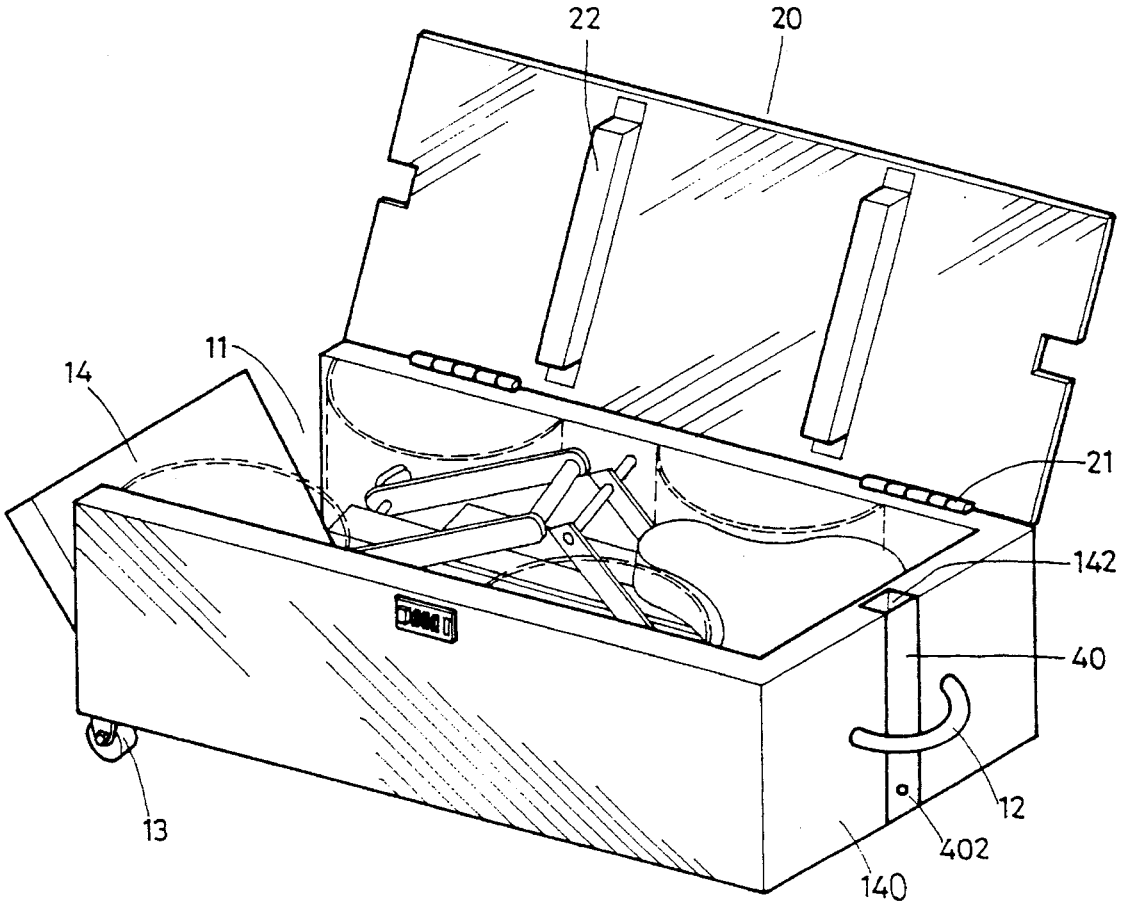
Figure 3:
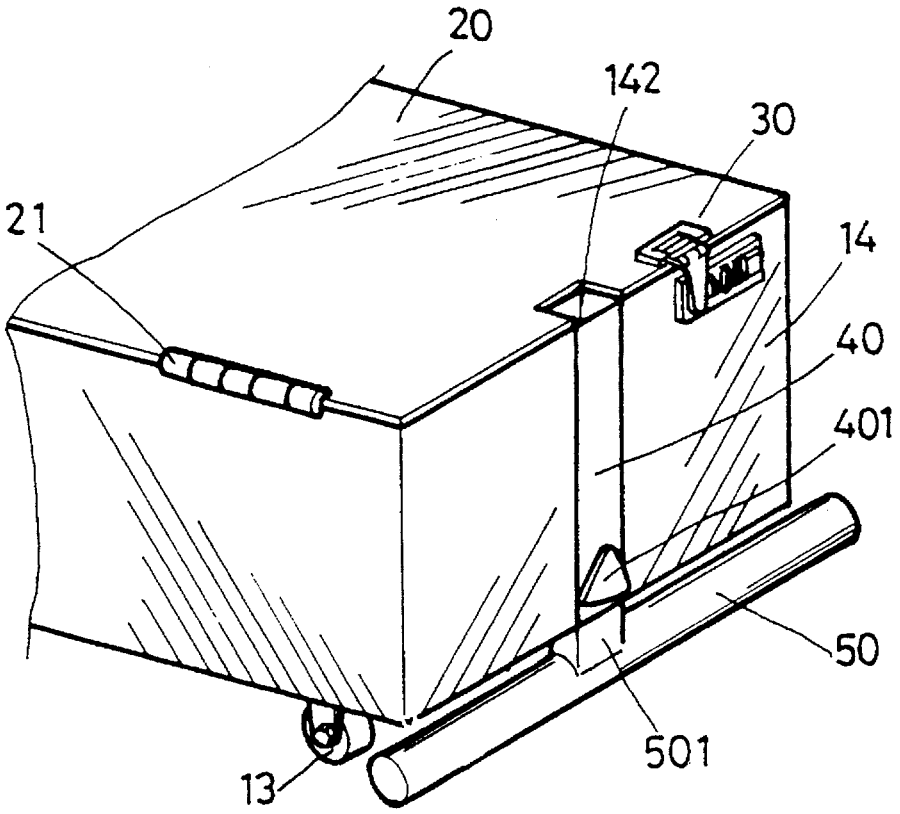
FIG. 3 is a partial perspective view of the exercise apparatus.
Figure 4:
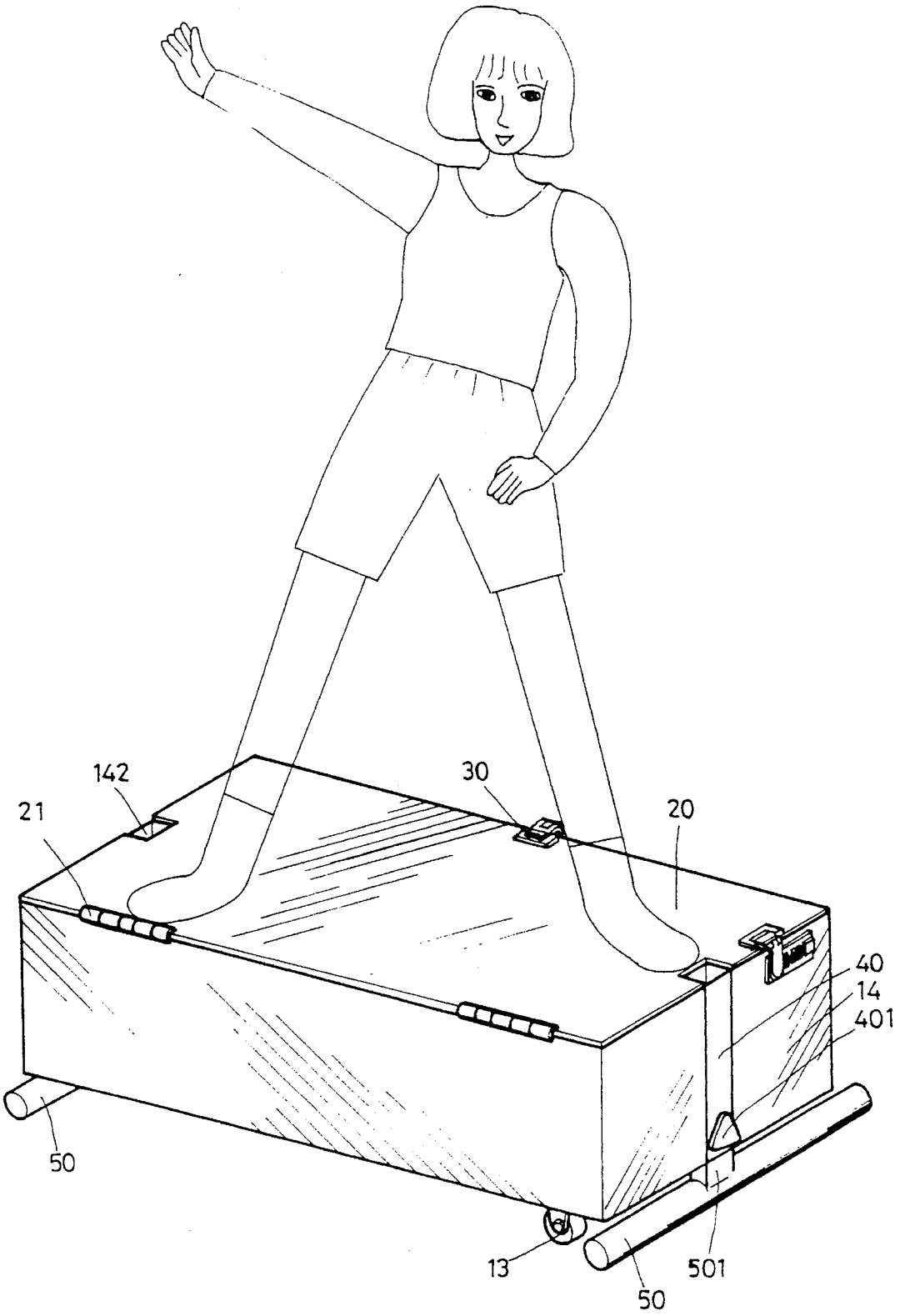
FIGS. 4 and 5 are perspective views illustrating the operation of the exercise apparatus.

The housing 10 includes a cover 20 pivotally coupled on top by hinge members 21 such that the cover 20 is rotatable about the hinge members 21. The cover 20 includes ribs 22 provided in the bottom portion for reinforcing purposes. Two lock devices 30 are provided for securing the cover 20 to the housing 10 and for securing the rear wall 14 to the cover 20 respectively. As shown in FIGS. 3 and 4, two rods 50 each includes a stud 501 extended from the middle portion thereof for engaging with the tube 40 such that the rods 50 for a base for stably supporting the housing 10. The studs 501 are secured to the tubes 40 by screws 401. Two bars 51 may further be secured to the tube 40 and may include soft sleeves 52 engaged thereon for engaging with the feet of the users, best shown in FIGS. 6 and 7.

Figure 5:
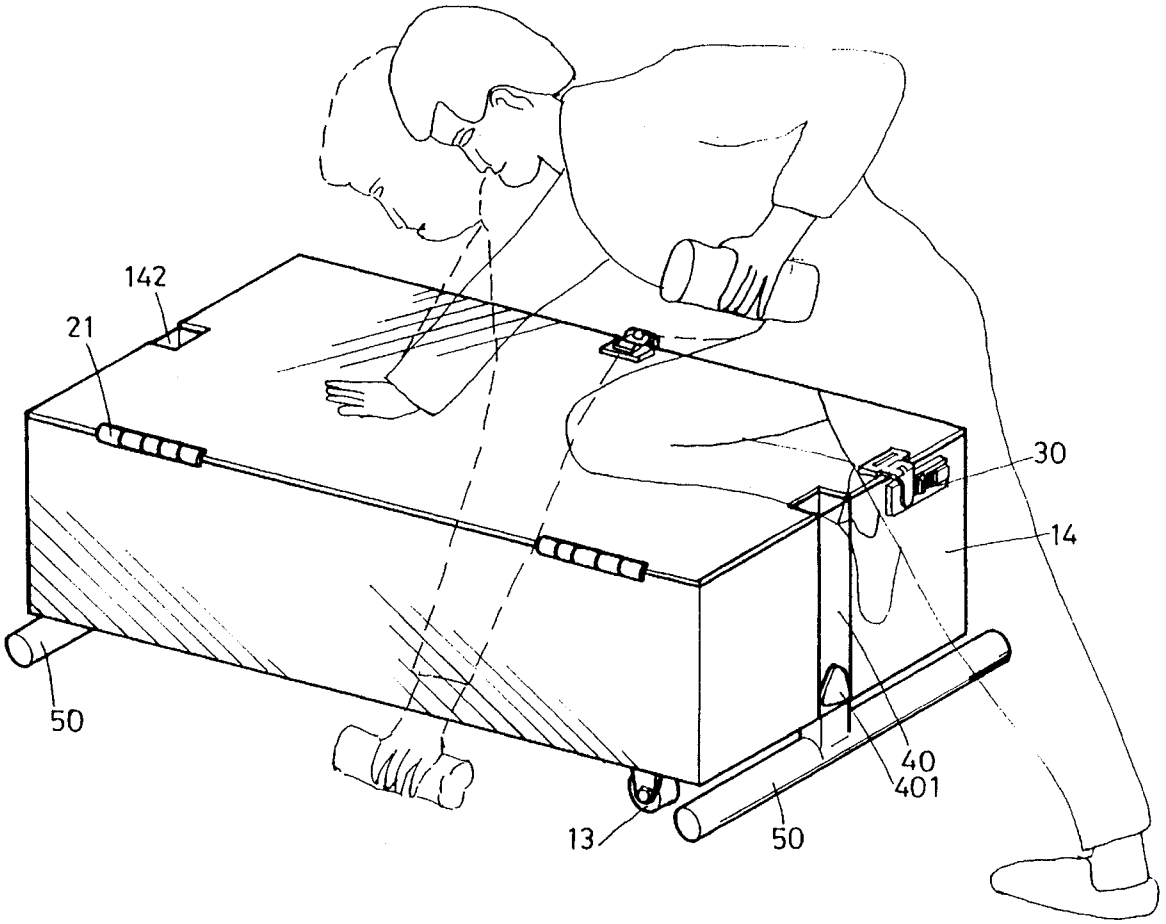
Figure 7:
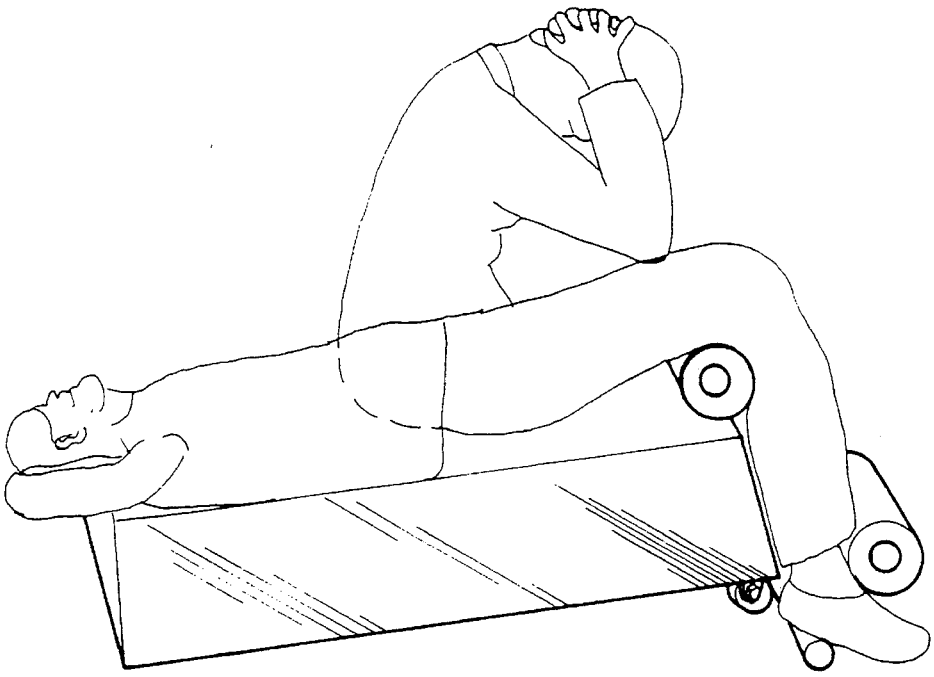
FIGS. 6, 7, 8 and 9 are perspective views illustrating the operation of the exercise apparatus.
Figure 6:
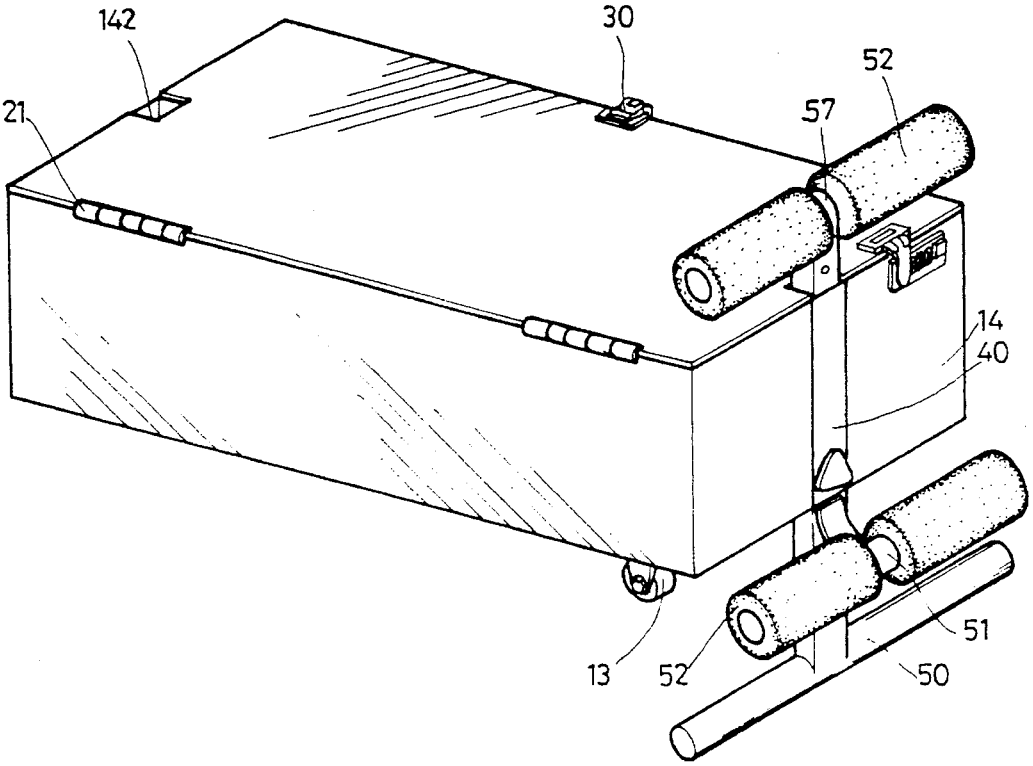

In operation, as shown in FIG. 4, the housing 10 may be provided for conducting acrobatic dance. As shown in FIG. 5, the users may use the housing 10 as a support for doing exercise with the dumb bells. As shown in FIGS. 6 and 7, the users may engage their feet with the sleeves 52 of the bars 51 so as to conduct sit-up exercises.

Accordingly, the exercise apparatus in accordance with the present invention may be provided for conducting various kinds of exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise apparatus comprising:

a housing including a hollow interior for accomodating objects, a rear wall and a front wall, an upper portion having a cover pivotally coupled to said housing, a rear portion having wheel means provided thereon for moving said housing, said rear wall and said front wall each including a hole vertically formed therein, a handle secured to said front wall for carrying said housing, means for pivotally coupling said cover and securing said cover to said housing, two tubes secured in said holes respectively, said tubes each including a bottom portion and an upper portion, two rods each including a stud extended therefrom for engaging with said bottom portion of said tube so as to form a stable base for said housing, two bars secured to said upper portion and said lower portion of at least one of said tubes, and at least one sleeve engaged on each of said tubes.

* * * * *